US008148888B2

(12) United States Patent
Hashizume

(10) Patent No.: US 8,148,888 B2
(45) Date of Patent: Apr. 3, 2012

(54) ELECTRON EMITTING DEVICE, AND ELECTRON BEAM DEVICE AND IMAGE DISPLAY APPARATUS INCLUDING THE SAME

(75) Inventor: Yohei Hashizume, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 12/898,171

(22) Filed: Oct. 5, 2010

(65) Prior Publication Data

US 2011/0084596 A1 Apr. 14, 2011

(30) Foreign Application Priority Data

Oct. 9, 2009 (JP) ..... 2009-235082

(51) Int. Cl.
*H01J 1/30* (2006.01)

(52) U.S. Cl. ..... 313/496; 313/326

(58) Field of Classification Search ..... None
See application file for complete search history.

(56) References Cited

U.S. PATENT DOCUMENTS 5,214,347 A * 5/1993 Gray ..... 313/355
7,012,362 B2 * 3/2006 Kawate et al. ..... 313/495
2001/0019247 A1 9/2001 Tsukamoto
2011/0074744 A1 * 3/2011 Nitobe et al. ..... 345/204

FOREIGN PATENT DOCUMENTS

JP 2001-229809 A 8/2001

* cited by examiner

*Primary Examiner* — Ashok Patel
(74) *Attorney, Agent, or Firm* — Canon U.S.A., Inc. IP Division

(57) ABSTRACT

A device includes a substrate, an insulating member disposed on a surface of the substrate, a gate, and a cathode. The insulating member has an upper surface apart from the surface of the substrate, and a side surface rising from the surface of the substrate between the upper surface and the surface of the substrate. The gate is disposed on the upper surface of the insulating member. The cathode is disposed on the side surface of the insulating member and has a portion opposing the gate. The side surface of the insulating member on which the cathode is disposed has a protruding portion protruding from an imaginary line connecting a position where the portion opposing the gate lies and a position where the insulating member rises from the surface of the substrate.

15 Claims, 9 Drawing Sheets

--PRIOR ART--

--PRIOR ART--

--PRIOR ART--

ELECTRON EMITTING DEVICE, AND ELECTRON BEAM DEVICE AND IMAGE DISPLAY APPARATUS INCLUDING THE SAME

BACKGROUND OF THE INVENTION

1. Field of the Invention

The present invention relates to an electron emitting device, and to an electron beam device and an image display apparatus that include the electron emitting device.

2. Description of the Related Art

As an alternative to CRTs, a low-profile display apparatus has been studied which includes a face plate including a plurality of light emitting members, and a rear plate having a plurality of electron emitting devices corresponding to the light emitting members. The face plate and the rear plate oppose each other with a distance of several millimeters therebetween. In such a low-profile display apparatus, the number of electron emitting devices is increased according to the demand for wide-screen and high-definition display apparatuses, while the power consumption is to be reduced. Accordingly, a low-profile image display apparatus including so-called vertical electron emitting devices that are expected to focus electron beams and to enhance the electron emission efficiency has been studied. This type of electron emitting device includes an insulating member having a cathode on its side surface and a gate on its upper surface. Japanese Patent Laid-Open No. 2001-229809 discloses a vertical electron emitting device and a low-profile image display apparatus including the same.

SUMMARY OF THE INVENTION

According to an aspect of the invention, a device is provided which includes a substrate having a substrate surface, an insulating member disposed on the substrate surface, a gate, and a cathode. The insulating member has an upper surface apart from the substrate surface, and a side surface rising from the substrate surface between the upper surface and the substrate surface. The gate is disposed on the upper surface. The cathode is disposed on the side surface and has a portion opposing the gate. The side surface has a protruding portion protruding from an imaginary line connecting a position where the portion opposing the gate lies and a position where the insulating member rises from the substrate surface of the substrate.

According to another aspect of the present invention, an electron beam device is provided which includes the electron emitting device, and an anode opposing the cathode and disposed over the gate.

According to another aspect of the present invention, an apparatus is provided which includes the electron emitting device, an anode opposing the cathode and disposed over the gate, and a light-emitting member disposed on the anode, emitting light by being irradiated with electrons.

Further features of the present invention will become apparent from the following description of exemplary embodiments with reference to the attached drawings.

DESCRIPTION OF THE EMBODIMENTS

Embodiments of the present invention can achieve an electron emitting device exhibiting further enhanced definition and further reduced power consumption, and an electron beam device and an image display apparatus that include the electron emitting device.

Exemplary embodiments will now be described with reference to the drawings.

Figure 1A:
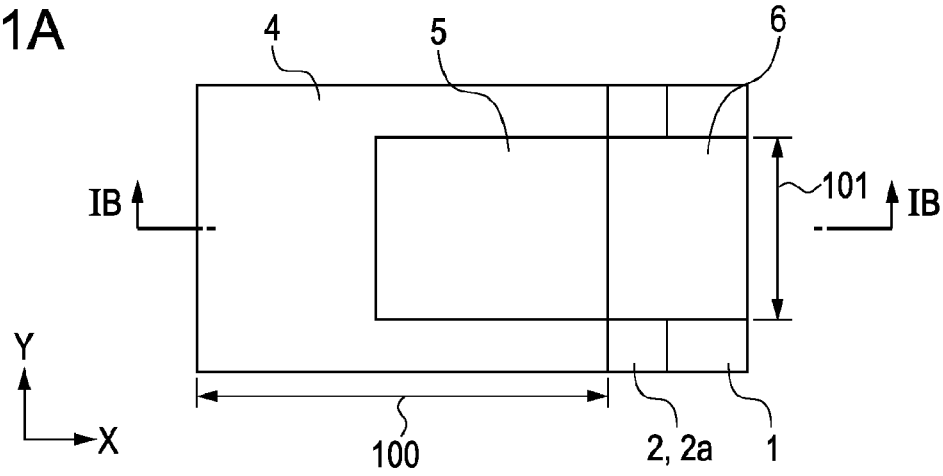
FIGS. 1A to 1C are a top view, a sectional view, and a fragmentary enlarged view, respectively, of an electron emitting device according to an embodiment of the present invention.
Figure 1B:
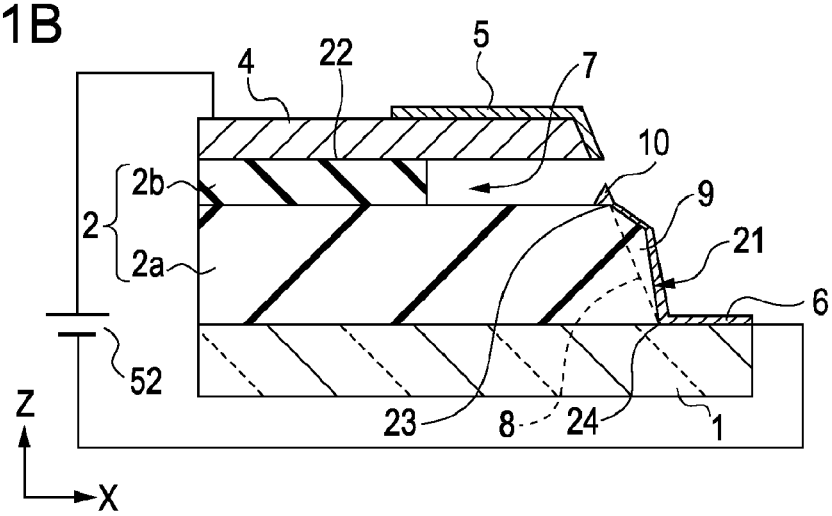
Figure 1C:
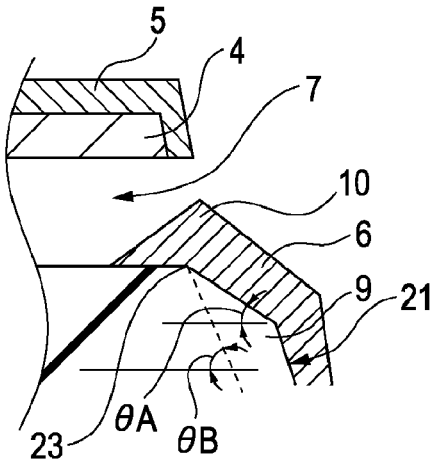

FIGS. 1A to 1C show an electron emitting device according to an embodiment of the present invention: FIG. 1A is a top view of the electron emitting device; FIG. 1B is a sectional view taken along line IB-IB in FIG. 1A; and FIG. 1C is a fragmentary enlarged view of a portion shown in FIG. 1B where a cathode 6 and a gate 4 oppose each other. As shown in FIGS. 1B and 1C, an insulating member 2 is disposed on the surface of a substrate 1. The insulating member 2 includes a first insulating layer 2*a* and a second insulating layer 2*b*. The insulating member 2 has an upper surface 22 apart from the surface of the substrate 1, and a side surface 21 rising from the surface of the substrate 1 between the upper surface 22 and the surface of the substrate 1. Further, a gate 4 is provided on the upper surface 22 of the insulating member 2, and a cathode 6 opposing the gate 4 is disposed on part of the side surface 21 of the insulating member 2. A voltage Vf is applied to the gate 4 and the cathode 6 from a power source 52 so that the potential of the gate 4 becomes higher than that of the cathode 6. In the present embodiment, the cathode 6 has a projection portion 10 at the position where the cathode 6 opposes the gate 4. The dashed line 8 shown in FIG. 1B is an imaginary line connecting the position 23 of the side surface 21 of the insulating member 2 where the projection portion 10 of the cathode 6 lies and the position 24 where the cathode 6 rises from the surface of the substrate 1. The side surface 21 of the insulating member 2 has a protruding portion 9 protruding from the imaginary line 8. The imaginary line 8 forms an angle of θB with respect to the surface of the substrate 1, as shown in FIG. 1C. By providing the insulating member 2 with the protruding portion 9 protruding from the imaginary line 8, the capacitance of the capacitor formed between the gate 4 and the cathode 6 can be reduced in comparison with the case where the protruding portion 9 is not provided.

Consequently, the electron emitting devices can be arranged so as to achieve high definition and, in addition, the power consumption can be reduced. This will be further described in detail.

The capacitance of the capacitor formed between the gate 4 and the cathode 6 causes a charge not contributing to electron emission and stored between the gate 4 and the cathode 6 when a voltage is applied between the cathode 6 and the gate 4. It is therefore important to reduce the capacitance from the viewpoint of reducing undesired consumption of power. The capacitance between the gate 4 and the cathode 6 is proportional to the area of the portion where the gate 4 and the cathode 6 oppose each other and the relative dielectric constant of the insulating member 2 between the gate 4 and the cathode 6, but is inversely proportional to the distance between the gate 4 and the cathode 6.

Figure 2A:
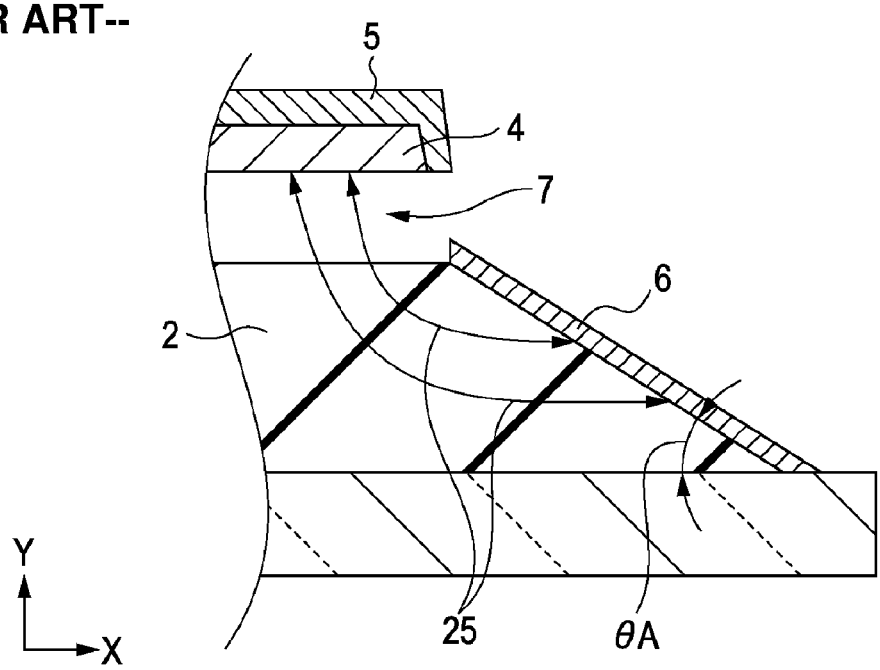
FIGS. 2A and 2B are fragmentary enlarged views of electron emitting devices of comparative examples.
Figure 2B:
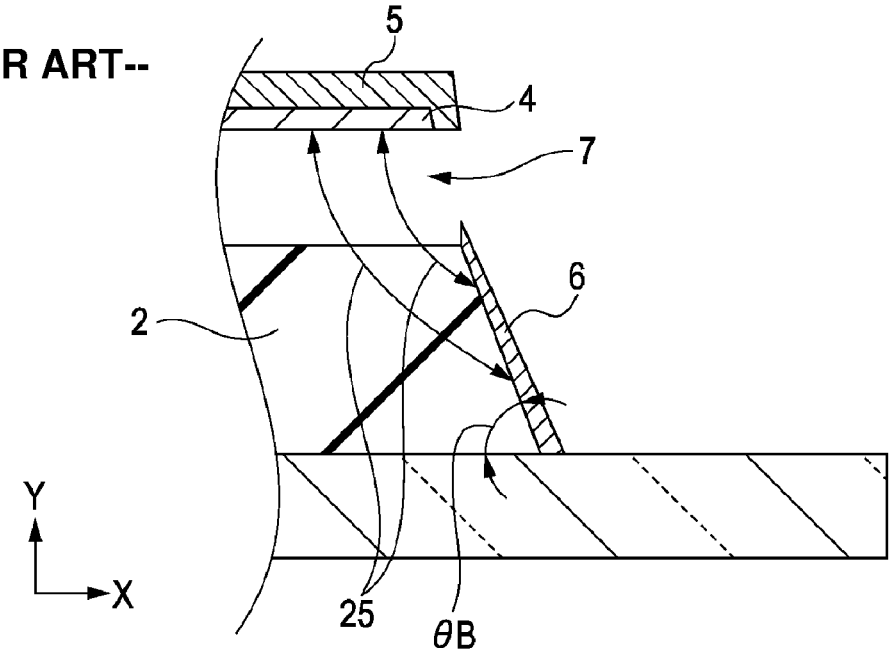

Accordingly, if the side surface of the insulating member 2 forms a small angle θA with the surface of the substrate 1, as shown in FIG. 2A, the distance 25 between the gate 4 and the cathode 6 through the insulating member 2 is increased. Thus, the capacitance between the gate 4 and the cathode 6 can be reduced. In the case shown in FIG. 2A, however, the insulating member 2 occupies a larger area of the surface of the substrate 1. This makes it difficult to arrange the electron emitting devices so as to achieve high definition. If the side surface of the insulating member 2 forms a large angle θB with the surface of the substrate 1, as shown in FIG. 2B, the area of the surface of the substrate 1 occupied by the insulating member 2 is reduced. This allows the electron emitting devices to be arranged so as to achieve high definition. However, it becomes difficult to reduce the capacitance between the gate 4 and the cathode 6 because the distance between the gate 4 and the cathode 6 through the insulating member 2 is reduced. In the present embodiment, the distance between the gate 4 and the cathode 6 through the insulating member 2 can be increased without increasing the area of the surface of the substrate occupied by the insulating member 2. Accordingly, the capacitance between the gate 4 and the cathode 6 can be reduced. In the present embodiment shown in FIG. 1B, the insulating member 2 has a protruding portion 9 protruding from the imaginary line 8 at the side surface 21 thereof, and the cathode 6 is disposed on the side surface 21 having the protruding portion 9. Consequently, the distance between the gate 4 and the cathode 6 through the insulating member 2 can be increased in comparison with the case shown in FIG. 2B. This means that the area of the surface of the substrate 1 occupied by the insulating member 2 can be kept the same as in FIG. 2B, while the capacitance can be reduced to an extent similar to the capacitance in the case shown in FIG. 2A. In other words, as shown in FIG. 1C, the imaginary line 8 forms a large angle θB as shown in FIG. 2B with the surface of the substrate 1 at the position 24 where the insulating member 2 rises from the surface of the substrate 1. On the other hand, the protruding portion 9 of the insulating member 2 has a surface forming a sufficiently small angle θA as in FIG. 2A with the surface of the substrate 1. This allows the distance between the gate 4 and the cathode 6 to be increased, and allows the capacitance to be reduced sufficiently. Consequently, the electron emitting devices can be arranged so as to achieve high definition while the power consumption can be reduced.

The distance between the cathode 4 and gate 6 through the insulating member 2 is large around the surface of the substrate. It is therefore effective in reducing the capacitance to increase the distance between the cathode 4 and the gate 6 around the position where the cathode 4 and the gate 6 oppose each other, where they come close to each other.

The peak of the protruding portion 9 can be apart from the surface of the substrate with a distance of 0.4 times or more with respect to the distance between the surface of the substrate and the portion opposing the gate 4 of the cathode 6 on the side surface 21 of the insulating member 2. The peak of the protruding portion 9 mentioned herein refers to the position of the side surface 21 of the insulating member 2 having the largest distance from the imaginary line 8.

Figure 7A:
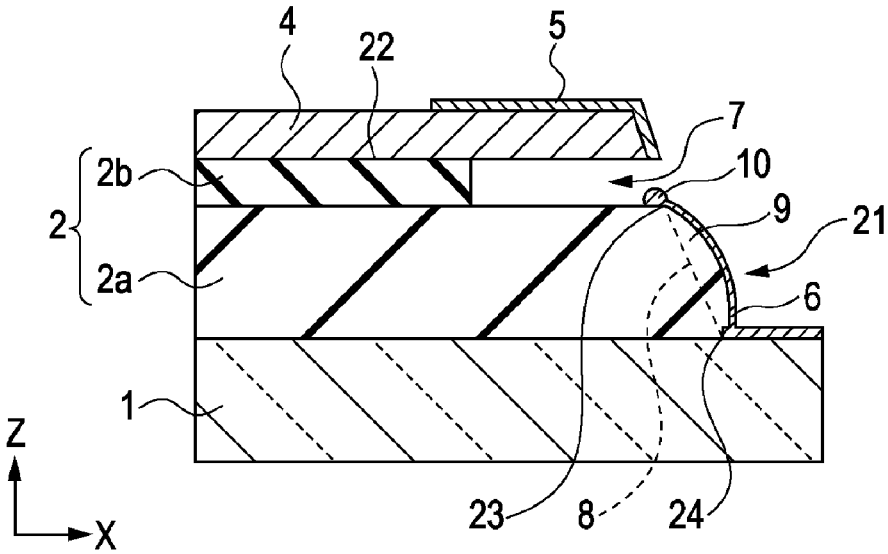
FIGS. 7A and 7B are sectional views of electron emitting devices according to other embodiments of the present invention.
Figure 7B:
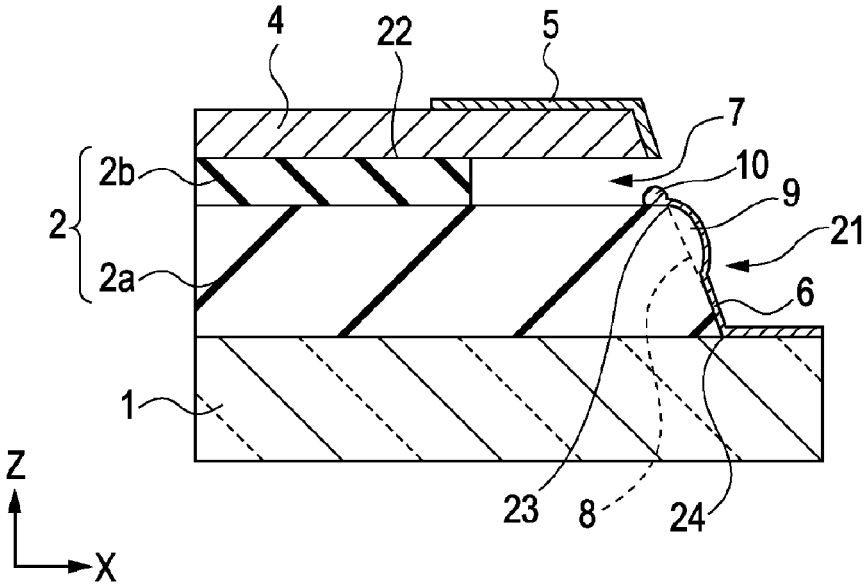

The protruding portion 9 is not limited to the form as shown in FIG. 1B that defined by two surfaces rising with respect to the surface of the substrate 1 at different angles, and may have an arc shape as shown FIG. 7A. Also, the protruding portion 9 may be formed at part of the side surface of the insulating member 2, as shown in FIG. 7B.

The insulating member 2 can have a recess 7 in the side surface 21 at the position where the portion of the cathode 6 opposing the gate 4 lies. Since the presence of the recess 7 increases the distance between the cathode 6 and the gate 4 through the insulating member 2, the leakage current flowing along the surface of the insulating member 2 between the cathode 6 and the gate 4 can be reduced. Consequently, the electron emission efficiency can be enhanced, and the power consumption can be reduced.

Although the insulating member 2 in the present embodiment has the recess 7 from the above reason, the recess 7 may not be formed. Although in the present embodiment, the insulating member 2 includes the first insulating layer 2*a* and the second insulating layer 2*b*, the insulating member 2 may be composed of a single insulating layer.

The cathode 6 can have a projection portion 10 rising toward the gate 4 from the edge of the recess 7 in the insulating member 2 at the position where the cathode 6 opposes the gate 4, as shown in FIGS. 1B and 1C. FIG. 1C is a fragmentary enlarged view of the region around the projection portion 10 shown in FIG. 1B. Since the electric field is strongly concentrated on the projection portion 10 at an end of the cathode 6, the voltage applied between the cathode 6 and the gate 4 can be reduced, and consequently the charge stored between the cathode 6 and the gate 4 can be reduced. Thus, the power consumption can be reduced.

The projection portion 10 of the cathode 6 can be in contact with the inner surface of the recess 7 in the insulating member 2. Such a form can stabilize the electron emission characteristics and prevent the changes of electron emission characteristics with time. This will be further described in detail. By bringing the projection portion 10 of the cathode 6 into contact with the surface defining the recess 7 of the insulating member 2, the contact portion of the cathode 6 with the insulating member 2 is spread not only over the side surface of the insulating member 2, but also to the inner surface of the recess 7, thereby enhancing the mechanical strength. Consequently, the projection portion 10 of the cathode 6 becomes difficult to separate from the insulating member 2, and the position of the projection portion 10 with respect to the gate 4 is stabilized. Accordingly, the electric field generated at the projection portion 10 of the cathode 6 is stabilized to enhance the stability of the electron emission characteristics. The projection portion 10 of the cathode 6 generates heat accompanied by electron emission. The heat can be efficiently dissipated in the structure in which the projection portion 10 is in contact with the surface of the recess 7 in the insulating member 2, and consequently, the electron emission characteristics can be prevented from changing with time.

Components of the electron emitting device of the present embodiment will now be described.

The substrate 1 may be made of quartz glass, glass whose dopant content, such as Na content, has been reduced, soda-lime glass, a composite including a Si substrate or the like and a $SiO_2$ layer formed on the substrate by sputtering or the like, or a ceramic, such as alumina. In the present embodiment, a highly distortion-resistant glass can be used, such as PD200 available from Asahi Glass.

The insulating member 2 can be made of a material having a resistant to high electric field, such as $SiO_2$ and other oxides and $Si_3N_4$ and other nitrides. As described above, a recess 7 can be formed in the side surface of the insulating member 2. In this instance, it is advantageous that the insulating member 2 includes two insulating layers, as shown in FIG. 1B. The second insulating layer 2*b* can be made of a material having a higher etching rate in an etching solution than the first insulating layer 2*a*. For example, if buffered hydrofluoric acid (hydrofluoric acid/ammonium fluoride solution) is used as an etching solution, the first insulating layer 2*a* can be made of an insulating material, such as $Si_3N_4$, and the second insulating layer 2*b* can be made of another insulating material, such as $SiO_2$.

The gate 4 can be made of an electrically conductive, thermally conductive material having a high melting point. Such materials include metals such as Be, Mg, Ti, Zr, Hf, V, Nb, Ta, Mo, W, Al, Cu, Ni, Cr, Au, Pt, and Pd; and alloys of those metals. Carbides may be used, such as TiC, ZrC, HfC, TaC, SiC, and WC. Also, the gate 4 may be made of a boride, such as $HfB_2$, $ZrB_2$, $CeB_6$, $YB_4$, or $GbB_4$; a nitride, such as TaN, TiN, ZrN, or HfN; or a semiconductor, such as Si or Ge. In addition, other material may be used, such as organic polymers, amorphous carbon, graphite, diamond-like carbon, and carbon and carbon compounds in which diamond has been dispersed. The gate can have a gate protruding portion 5 protruding upward on the gate 4, as shown in FIG. 1B. The width (length in the Y direction in FIG. 1A) of the gate protruding portion 5 can be smaller than that of the cathode 6 so as to reduce the number of scatterings of electrons emitted from the cathode 6 on the gate 4. Thus the electron emission efficiency can be enhanced. The gate protruding portion 5 may be made of the same material as cited above as the material of the gate 4, and in addition, materials that can be used for the cathode 6 may be used.

An electroconductive material capable of emitting electrons is suggested for the cathode 6. The cathode 6 is typically made of a material that has a high melting point of 2000° C. or more and a work function of 5 eV or less, and that does not easily form a chemical reaction layer, such as an oxide layer. Such materials include metals such as Hf, V, Nb, Ta, Mo, W, Au, Pt, and Pd; and alloys of these metals. The cathode may be made of a carbide, such as TiC, ZrC, HfC, TaC, SiC, or WC; a boride such as $HfB_2$, $ZrB_2$, $CeB_6$, $YB_4$, or $GdB_4$; and a nitride such as TiN, ZrN, HfN, or TaN. In addition, other materials may be used, such as amorphous carbon, graphite, diamond-like carbon, and carbon and carbon compounds in which diamond has been dispersed.

Turning now to FIGS. 4A to 5G, a method for manufacturing the electron emitting device according to the present embodiment will be described.

Figure 4A:
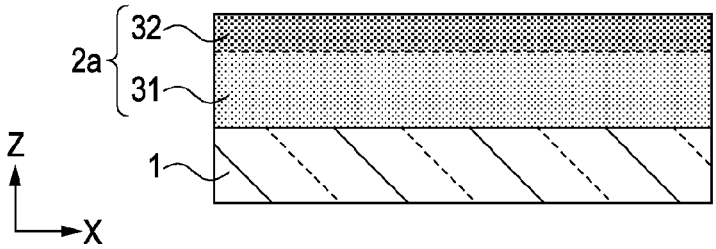
FIGS. 4A to 4D are representations of a process for manufacturing an electron emitting device according to an embodiment of the present invention.

As shown in FIG. 4A, a multilayer structure of the first insulating layer 2*a* is formed on a substrate 1 that has been sufficiently washed in advance. The layers of the multilayer structure of the first insulating layer 2*a* are formed under different conditions so that the layers have different etching rates from each other in a subsequent etching step. For example, if the layers are formed by sputtering, the gas pressure for sputtering can be varied. The layers may be formed by other methods, such as CVD or vacuum vapor deposition, without limiting the method to sputtering.

Figure 4B:
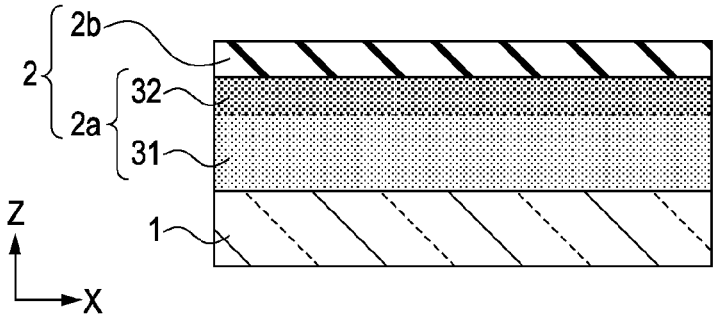
Figure 4C:
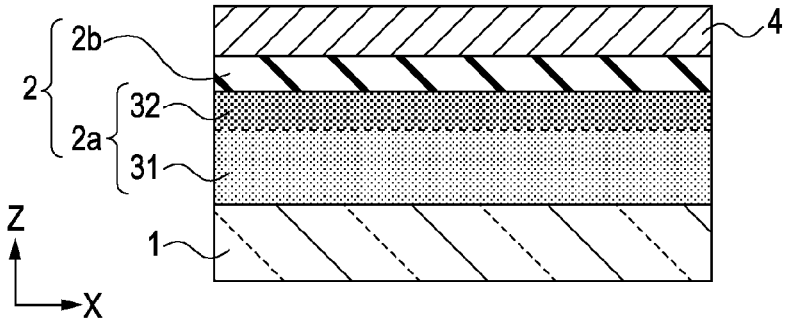

Subsequent to the formation of the first insulating layer 2*a*, the second insulating layer 2*b* and the gate 4 are formed, as shown in FIGS. 4B and 4C. The second insulating layer 2*b* and the gate 4 can also be formed by various methods, such sputtering, CVD, and vacuum vapor deposition.

Figure 4D:
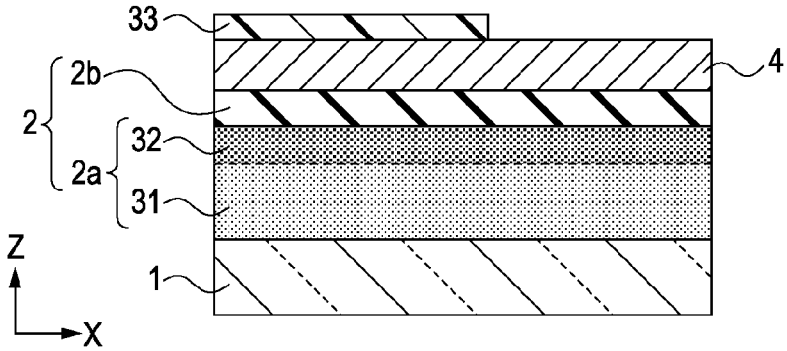

Turning to FIG. 4D, a photoresist is applied onto the surface of the gate 4 by, for example, spin coating and is then subjected to exposure and development to form a resist pattern 33 in a region on the gate 4.

Figure 5A:
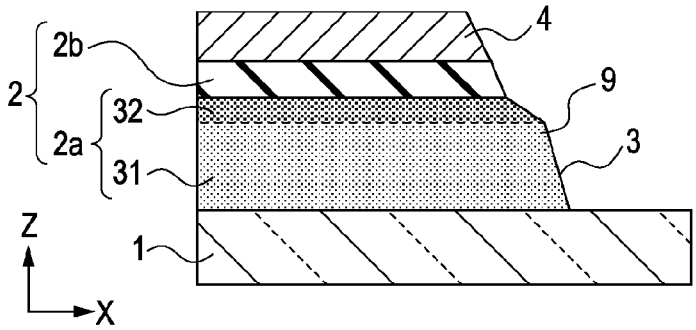
FIGS. 5A to 5C are representations of other steps of the process shown in FIGS. 4A to 4D.

Turning then to FIG. 5A, part of the first insulating layer 2*a*, the second insulating layer 2*b* and the gate 4 are removed at one time by etching through the resist pattern 33. The etching may be performed by a dry process or a wet process. It is desired that the etched surfaces be smooth, and the method for etching in this step can be selected according to the materials of the members to be etched. For example, dry etching may be performed on a $Si_3N_4$ first insulating layer 2*a*, a $SiO_2$ second insulating layer 2*b* and a TaN gate 4 using $CF_4$ gas as an etching gas. In this instance, since the first insulating layer 2*a* includes layers formed so as to have different etching rates by varying the sputtering gas pressure, as described above, the side surface of the first insulating layer 2*a* forms at least two rising angles with respect to the surface of the substrate 1.

Subsequently, turning to FIG. 5B, a recess 7 is formed in the insulating member 2 by, for example, wet etching. For example, if a $Si_3N_4$ first insulating layer 2*a*, a $SiO_2$ second insulating layer 2*b* and a TaN gate 4 are formed, as mentioned above, buffered hydrofluoric acid is used as an etching solution. Thus, the second insulating layer 2*b* is selectively etched to form a recess 7 in the side surface of the insulating member 2.

Figure 5B:
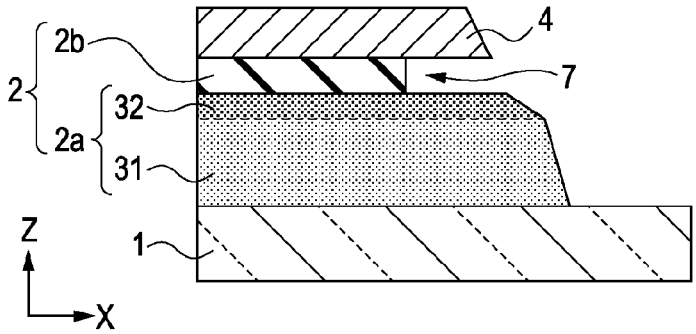
Figure 5C:
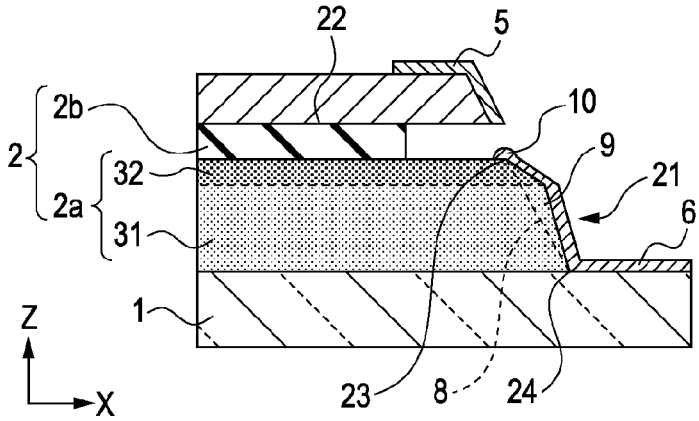

Subsequently, a cathode 6 is formed on the side surface having the recess 7 of the insulating member 2, and a gate protruding portion 5 is formed on the surface of the gate 4, as shown in FIG. 5C. The cathode 6 and the gate protruding portion 5 can be formed by, for example, sputtering or vacuum vapor deposition. In this step, it is important that the angle of vapor deposition, the deposition time, the temperature and the vacuum are precisely controlled so that a projection portion 10 rising toward the gate 4 can be formed to the cathode 6, and so that the projection portion 10 can come into contact with the inner surface of the recess 7 of the insulating member 2. The resulting coatings formed in the above step are patterned into the cathode 6 and the gate protruding portion 5 by photolithography.

Thus the electron emitting device of the present embodiment is formed.

Figure 3:
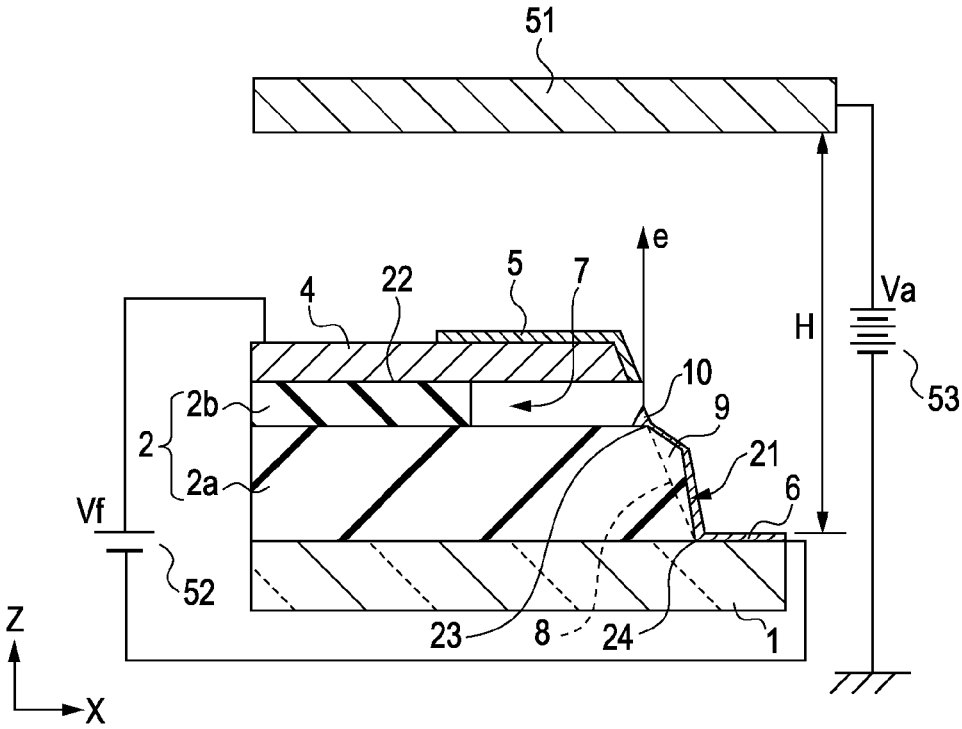
FIG. 3 is a sectional view of an electron beam device according to an embodiment of the present invention.

An electron beam device including the electron emitting device will now be described. FIG. 3 shows the structure of an electron beam device including the electron emitting device shown in FIG. 1B. In FIG. 3, the substrate 1, the insulating member 2, the gate 4, the gate protruding portion 5, the cathode 6, the recess 7, the imaginary line 8, the protruding portion 9 of the insulating member 2, the projection portion 10 of the cathode 6 are the same as in the above description. The electron beam device further includes an anode 51. The anode 51 is disposed apart from the surface of the substrate 1 with a distance H and opposes the projection portion 10 of the cathode 6 over the gate 4. A high-voltage power supply 53 applies a high voltage Va to the anode 51, and accelerates electrons emitted from the cathode 6 to the anode 51. By disposing the anode 51 over the gate 4 so as to oppose the cathode 6, as above, the cathode 6 can more efficiently emit electrons.

Figure 6:
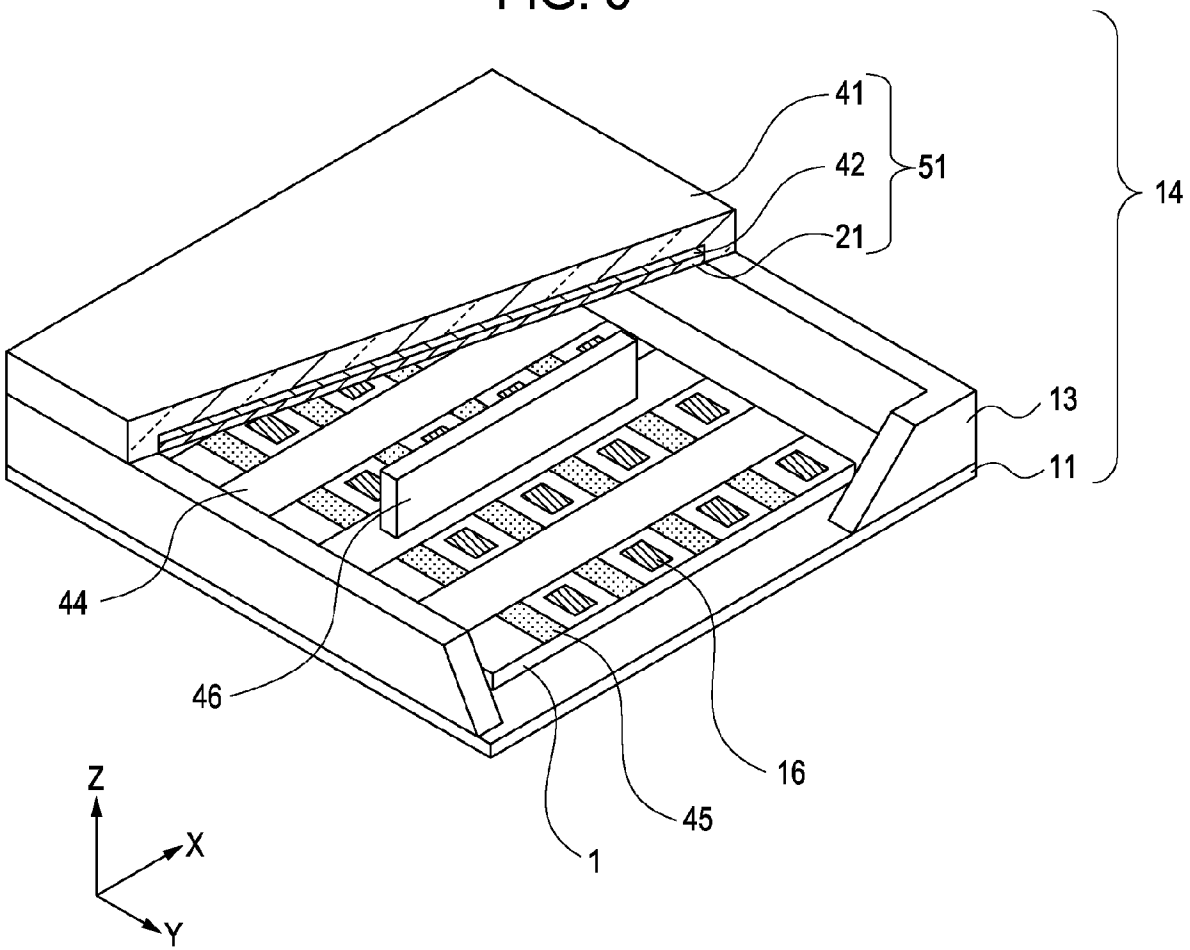
FIG. 6 is an exploded perspective view an image display apparatus according to an embodiment of the present invention.

An image display apparatus including the electron emitting device will now be described. FIG. 6 shows the structure of an image display apparatus including the electron emitting device shown in FIG. 1B. The image display apparatus has a rear plate 11, and a plurality of electron emitting devices 16 are disposed on the rear plate 11. Each electron emitting device 16 includes an insulating member 2 having a recess 7 in a side surface thereof shown in FIG. 1B and a protruding portion 9 at the side surface, a gate 4, a gate protruding portion 5, and a cathode 6 (those elements are not shown in FIG. 6), on the surface of the substrate 1. The image display apparatus 14 further includes on the surface of the substrate 1. X-direction wirings 44 connecting the cathodes of the electron emitting devices 16 to each other, and Y-direction wirings 45 connecting the gates to each other. A face plate 12 is also disposed which includes an optically transparent glass substrate 41, an anode 51 on the glass substrate 41, and fluorescent members 42 disposed on the anode 51 and acting as a plurality of light emitting members. The fluorescent members 42 emit light by being irradiated with electrons emitted from the electron emitting devices 16. The rear plate 11 and the face plate 12 are joined together with a supporting frame 13 therebetween, and the interior of the resulting structure is evacuated to a vacuum to complete the image display apparatus 14. In the present embodiment, a spacer 46 for maintaining the structure against atmospheric pressure is disposed between the rear plate 11 and the face plate 12 according the upsizing of the image display apparatus. This may be a desirable structure from the viewpoint of reducing the weight of the image display apparatus. For operating the image display apparatus, while a scanning signal is applied to the X-direction wirings 44 and a data signal is applied to the Y-direction wirings 45, a high voltage Va is applied to the anode 51 to accelerate electrons emitted from the electron emitting devices to the anode 51, and thus the fluorescent members 42 acting as light emitting members is irradiated with the accelerated electrons. An image is thus displayed by emitting light selectively from fluorescent members 42.

Example 1

A specific example will be described below. In Example 1, an electron emitting device having the structure shown in FIGS. 1A to 1C was prepared, and an electron beam device having the structure show in FIG. 3 including the electron emitting device was produced. The electron emitting device was prepared in a process shown in FIGS. 4A to 5G. Details will be described below.

Step 1:

After washing a soda-lime glass substrate 1, a 400 nm thick $Si_3N_4$ insulating film 31 and a 100 nm thick $Si_3N_4$ insulating film 32 were formed as the first insulating layer 2*a* on the substrate 1 by sputtering. In this step, the sputtering pressure for depositing the insulating film 32 was twice as high as the sputtering pressure for the insulating film 31. The first insulating layer 2*a* including the insulating films 31 and 32 was thus formed as shown in FIG. 4A.

Step 2:

Subsequently, a 30 nm thick $SiO_2$ layer and a 50 nm thick TaN layer were formed respectively as the second insulating layer 2*b* and the gate 4 shown in FIGS. 4B and 4C by sputtering. Thus, a multilayer structure including an insulating member 2 including the first insulating layer 2*a* and the second insulating layer 2*b*, and the gate 4 was prepared.

Step 3:

Subsequently, a positive photoresist (TSMR-98 produced by TOKYO OHKA KOGYO) was applied on the gate by spin coating, and was then subjected to exposure through a photomask and development to form a resist pattern 33 shown in FIG. 4D.

Step 4:

Then, the first insulating layer 2*a*, the second insulating layer 2*b* and the gate 4 were etched through the resist pattern 33 as a mask in a dry etching process using $CF_4$ gas, thus being patterned as shown in FIG. 5A. In this instance, the length in the X direction (designated by reference numeral 100 in FIG. 1A) of the gate 4 was set to 8 μm. The side surface of the first insulating layer 2*a* includes a portion of the insulating film 31 having a height of 400 nm from the surface of the substrate 1, and a portion of the 100 nm thick insulating layer 32 overlying the portion of the insulating film 31. The insulating film 31 has a side surface rising at 85° with respect to the surface of the substrate 1, and the insulating film 32 has a side surface rising at 35° with respect to the surface of the substrate 1. The imaginary line 8 connecting the upper end of the side surface of the first insulating layer 2*a*, at which the portion opposing the gate 4 of the cathode 6 would be formed in a subsequent step, and the position where the side surface of the first insulating layer 2*a* rises from the surface of the substrate 1 formed an angle of 70° with the surface of the substrate 1. Thus a protruding portion 9 is formed at the side surface of the first insulating layer 2*a* in such a manner that the peak of the protruding portion 9 is 400 nm apart from the surface of the substrate 1. Thus, the insulating member 2 was provided with the protruding portion 9 at the side surface thereof.

Step 5:

Subsequently, the second insulating layer 2*b* was etched using buffered hydrofluoric acid (LAL 100 produced by Stella Chemifa) as an etching solution to form a recess 7 to a depth of 60 nm in the side surface of the insulating member 2, as shown in FIG. 5B.

Step 6:

Subsequently, Mo was deposited to a thickness of 10 nm on the side surface of the insulating member 2 and the side surface and upper surface of the gate 4 by oblique vapor deposition from above under precisely controlled conditions at an angle of 60° with respect to the surface of the substrate 1 at a vapor deposition rate of 5 nm/min for 2 minutes. Then, the Mo layer was patterned by photolithography to form a cathode 6 over the protruding portion 9 at the side surface of the insulating member 2 and a gate protruding portion 5 on the upper surface and a side surface of the gate 4, as shown in FIG. 5C. In this instance, the length in the Y direction (designated by reference numeral 101 in FIG. 1A) of the cathode 6 and the gate protruding portion 5 was set to 200 μm. The cathode 6 had the projection portion 10 rising toward the gate 4 from the portion opposing the gate 4 in the recess 7 of the insulating member 2. The projection portion 10 was located in the recess 15 nm inward and was in contact with the inner surface of the recess 7. The imaginary line 8 connecting the edge 23 of the recess 7 formed in the side surface of insulating member 2, at which the portion of the cathode 6 opposing the gate 4 lies, and the position 24 where the side surface of the insulating member 2 rises from the surface of the substrate 1 formed an angle of 70° with the surface of the substrate 1, as described above. The thus prepared electron emitting device was provided with an anode 51 over the gate 4 so as to oppose the projection portion 10 of the 6 cathode, as shown in FIG. 3. An electron beam device was thus prepared.

In the electron beam device in Example 1, the capacitance between the gate 4 and the cathode 6 was measured and was 0.04 pF.

Example 2

In Example 2, an electron emitting device having the structure shown in FIG. 7A was prepared, and an electron beam device having the structure show in FIG. 3 including this electron emitting device was produced. FIG. 7A is a sectional view similar to FIG. 1B showing the electron emitting device of the present Example. The manufacturing process will be described below.

Figure 8A:
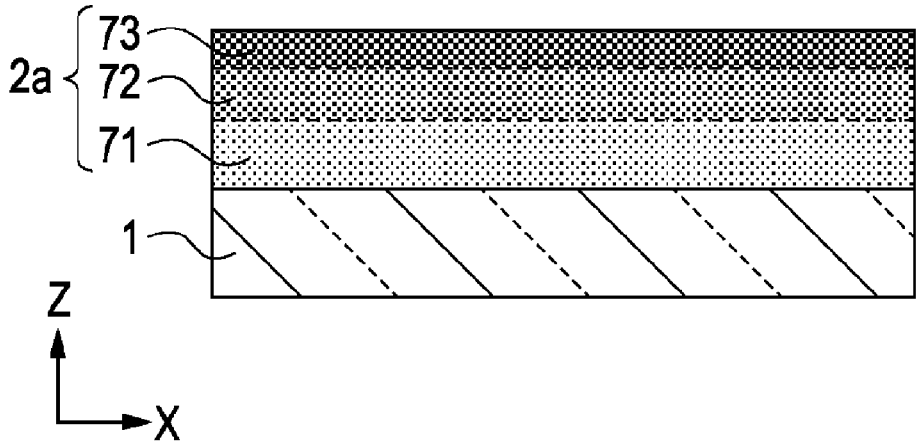
FIGS. 8A and 8B are representations of steps of processes for manufacturing an electron emitting device according to other embodiments.

Step 1:

After washing a soda-lime glass substrate 1, $Si_3N_4$ insulating films 71, 72 and 73 were formed as the first insulating layer 2*a* on the substrate 1 to thicknesses of 200 nm, 200 nm and 100 nm, respectively, by sputtering, as shown in FIG. 8A. In this step, the sputtering pressure for depositing the insulating film 72 and 73 were respectively 1.5 times and twice as high as the sputtering pressure for the insulating film 71. The first insulating layer 2*a* including the insulating films 71, 72 and 73 was thus formed to a thickness of 500 nm, as shown in FIG. 8A.

The subsequent steps were performed to prepare an electron beam device in the same manner as in Steps 2 to 6 in Example 1. As shown in FIG. 7A, the protruding portion 9 of the side surface of the insulating member 2 was in a substantially arc shape, and the peak of the protruding portion 9 was 250 nm apart from the surface of the substrate 1 and protrudes 70 nm from the imaginary line 8 connecting the edge 23 of the side surface of the insulating member 2 and the position 24 where the side surface of the insulating member 2 rises from the surface of the substrate 1. The imaginary line 8 formed an angle of 70° with the surface of the substrate 1.

In the electron beam device in Example 2, the capacitance between the gate 4 and the cathode 6 was measured and was 0.04 pF.

Example 3

In Example 3, an electron emitting device having the structure shown in FIG. 7B was prepared, and an electron beam device having the structure show in FIG. 3 including this electron emitting device was produced. FIG. 7B is a sectional view similar to FIG. 1B showing the electron emitting device of the present Example. The manufacturing process will be described below.

Figure 8B:
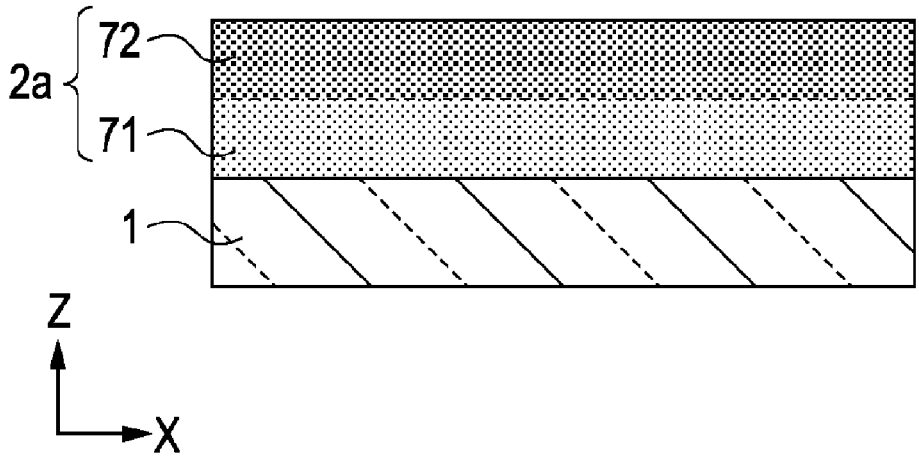

Step 1:

After washing a soda-lime glass substrate 1, $Si_3N_4$ insulating films 71 and 72 were formed as the first insulating layer 2*a* on the substrate 1 to a thickness of 250 nm each by sputtering, as shown in FIG. 8B. In this step, the sputtering pressure for depositing the insulating film 72 was three times as high as the sputtering pressure for the insulating film 71. The first insulating layer 2*a* including the insulating films 71 and 72 was thus formed to a thickness of 500 nm, as shown in FIG. 8B.

The subsequent steps were performed to prepare an electron beam device in the same manner as in Steps 2 to 6 in Example 1. As shown in FIG. 7B, the protruding portion 9 of the side surface of the insulating member 2 was in a substantially arc shape, and the peak of the protruding portion 9 was 380 nm apart from the surface of the substrate 1 and protrudes 100 nm from the imaginary line 8 connecting the edge 23 of the side surface of the insulating member 2 and the position 24 where the side surface of the insulating member 2 rises from the surface of the substrate 1. The imaginary line 8 formed an angle of 70° with the surface of the substrate 1.

In the electron beam device in Example 3, the capacitance between the gate 4 and the cathode 6 was measured and was 0.045 pF.

Comparative Example

Figure 9:
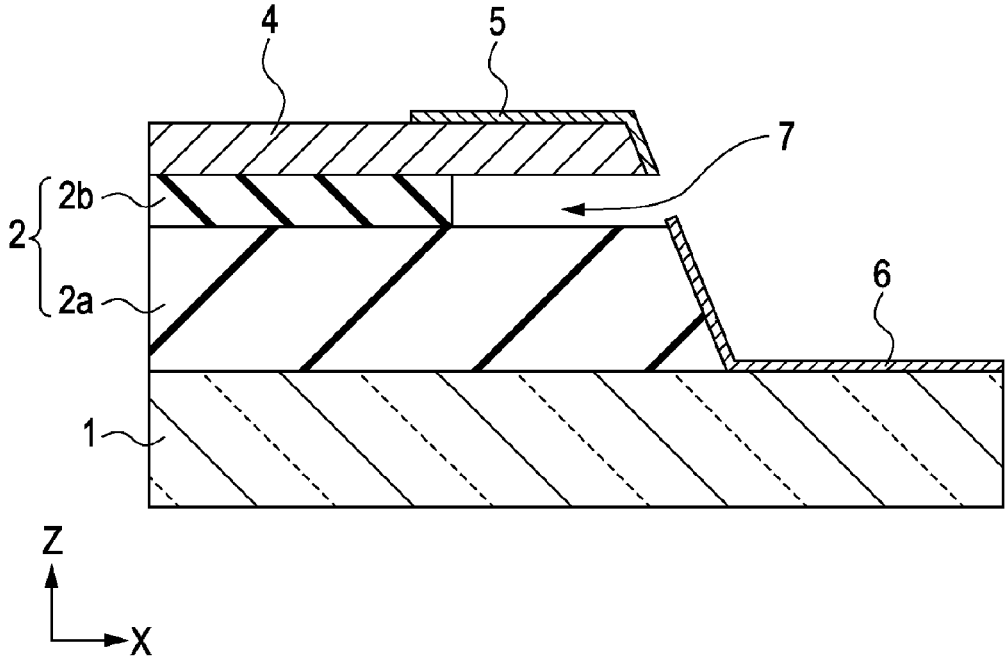
FIG. 9 is a sectional view of an electron emitting device of a comparative example.

An electron beam device was prepared in the same manner as in Example 1 except that the protruding portion 9 was not formed at the side surface of the insulating member 2 of the electron emitting device. FIG. 9 is a sectional view similar to FIG. 1B showing the electron emitting device of the Comparative Example. In the following description, only the steps different from those in Example 1 will be described.

Step 1:

After washing a soda-lime glass substrate 1, a 500 nm thick $Si_3N_4$ insulating film was formed as the first insulating layer 2*a* on the substrate by sputtering. The side surface of the insulating member 2 formed an angle of 70° with the surface of the substrate 1.

In the electron beam device of the Comparative Example, the capacitance between the gate 4 and the cathode 6 was measured and was 0.05 pF.

Example 4

In Example 4, an image display apparatus shown in FIG. 6 was produced using the electron emitting device prepared in Example 1.

In the image display apparatus of the present example, electron emitting devices 16 of 200 μm by 630 μm in dimensions were arranged on a substrate 1 in a 320×240 matrix manner with X-direction wirings 44 having a width of 320 μm and Y-direction wirings 45 having a width of 25 μm.

Subsequently, a face plate 12 was disposed 2 mm above a rear plate 11 having the substrate 1 so as to oppose the substrate 1, and the face plate 12 and the rear plate 11 were joined together with a supporting frame 13 therebetween. The interior of the resulting structure was evacuated to a vacuum to complete the image display apparatus 14. Five plate spacers 46 of 64 mm in the X direction by 200 μm in the Y direction were disposed between the rear plate 11 and the face plate 12. For joining the rear plate 11 and the supporting frame 13, and joining the supporting frame 13 and the face plate 12, indium was used.

The electron emitting devices 16 were operated by applying a scanning signal to the X-direction wirings 44 and a data signal to the Y-direction wirings 45. A pulsed voltage of +6V was used as the data signal, and a pulsed voltage of −10 V was used as the scanning signal. A high voltage of 6 kV was applied to the anode 51. Electrons were thus emitted from the electron emitting devices. The fluorescent members 42 were collided with the electrons and excited, thereby emitting light to display an image. As a result, a highly bright image was displayed with a high definition.

It was found that the capacitance of the image display apparatus of Example 4 was reduced to 90% of the capacitance of the image display apparatus including electron emitting devices prepared in the Comparative Example. Accordingly, the power consumption was reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-235082 filed Oct. 9, 2009, which is hereby incorporated by reference herein in its entirety.

What is claimed is:

1. An electron emitting device comprising:

a substrate having a substrate surface;

an insulating member disposed on the substrate surface, the insulating member having an upper surface apart from the substrate surface, and a side surface rising from the substrate surface between the upper surface and the substrate surface;

a gate disposed on the upper surface; and a cathode disposed on the side surface, the cathode having a portion opposing the gate, wherein the side surface has a protruding portion protruding from an imaginary line connecting a position where the portion opposing the gate lies and a position where the insulating member rises from the substrate surface.

2. The electron emitting device according to claim 1, wherein the protruding portion has a peak, and a distance between the peak and the substrate surface is 0.4 or more times of a distance between the substrate surface and the position where the portion opposing the gate lies.

3. The electron emitting device according to claim 1, wherein the insulating member has a recess at the position where the portion of the cathode lies.

4. The electron emitting device according to claim 3, wherein the cathode has a projection portion rising toward the gate from an edge of the recess of the insulating member, at the position where the portion opposing the gate lies.

5. The electron emitting device according to claim 4, wherein the projection portion is in contact with an inner surface of the recess in the insulating member.

6. An electron beam device comprising: the electron emitting device as set forth in claim 1; and an anode opposing the cathode, disposed over the gate.

7. The electron beam device according to claim 6, wherein the protruding portion has a peak, and a distance between the peak and the substrate surface is 0.4 or more times of a distance between the substrate surface and the position where the portion opposing the gate lies.

8. The electron beam device according to claim 6, wherein the insulating member has a recess at the position where the portion of the cathode lies.

9. The electron beam device according to claim 8, wherein the cathode has a projection portion rising toward the gate from an edge of the recess of the insulating member, at the position where the portion opposing the gate lies.

10. The electron beam device according to claim 9, wherein the projection portion is in contact with an inner surface of the recess in the insulating member.

11. An apparatus comprising the electron emitting device as set forth in claim 1; an anode opposing the cathode and disposed over the gate; and a light emitting member disposed on the anode, the light emitting member emitting light by being irradiated with electrons.

12. The apparatus according to claim 11, wherein the protruding portion has a peak, and a distance between the peak and the substrate surface is 0.4 or more times of a distance between the substrate surface and the position where the portion opposing the gate lies.

13. The apparatus according to claim 11, wherein the insulating member has a recess at the position where the portion of the cathode lies.

14. The apparatus according to claim 13, wherein the cathode has a projection portion rising toward the gate from an edge of the recess of the insulating member, at the position where the portion opposing the gate lies.

15. The apparatus according to claim 14, wherein the projection portion is in contact with an inner surface of the recess in the insulating member.

* * * * *